US007519315B2

(12) United States Patent
Tatsumi et al.

(10) Patent No.: US 7,519,315 B2
(45) Date of Patent: Apr. 14, 2009

(54) DEVELOPING UNIT

(75) Inventors: Eiji Tatsumi, Osaka (JP); Takahisa Nakaue, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 79 days.

(21) Appl. No.: 11/380,422

(22) Filed: Apr. 27, 2006

(65) Prior Publication Data

US 2006/0245791 A1 Nov. 2, 2006

(30) Foreign Application Priority Data

Apr. 28, 2005 (JP) ..... 2005-133091

(51) Int. Cl.
*G03G 15/08* (2006.01)

(52) U.S. Cl. ..... 399/254; 399/275; 399/277

(58) Field of Classification Search ..... 399/254, 399/255, 119, 120, 267, 272, 273, 277, 282
See application file for complete search history.

(56) References Cited

U.S. PATENT DOCUMENTS

| | | | | |
|---|---|---|---|---|
| 6,067,433 | A * | 5/2000 | Kimura et al. | 399/275 |
| 6,249,664 | B1 * | 6/2001 | Sato | 399/256 |
| 6,366,755 | B1 * | 4/2002 | Takashima | 399/254 |
| 6,577,834 | B2 * | 6/2003 | Suzuki | 399/254 |
| 2003/0185599 | A1 * | 10/2003 | Enoki et al. | 399/277 |
| 2004/0179865 | A1 * | 9/2004 | Nishiyama | 399/254 |
| 2005/0123312 | A1 * | 6/2005 | Mabuchi | 399/30 |
| 2006/0204283 | A1 * | 9/2006 | Yasuda | 399/254 |

FOREIGN PATENT DOCUMENTS

| | | | |
|---|---|---|---|
| JP | U-S64-15259 | | 1/1989 |
| JP | 02226272 A | * | 9/1990 |
| JP | 4/60665 A | | 2/1992 |
| JP | 10/123816 A | | 5/1998 |
| JP | 2002/148915 A | | 5/2002 |

* cited by examiner

*Primary Examiner*—David M Gray
*Assistant Examiner*—Laura K Roth
(74) *Attorney, Agent, or Firm*—Shinjyu Global IP

(57) ABSTRACT

A developing unit in an image forming device is disclosed in which developer peeled off from a developing roller can be reliably retrieved to an agitation transport member and avoid being directly drawn thereto. A developing unit has a drawing magnetic pole and a peel-off magnetic pole. A first agitation transport member is arranged below a developing roller and agitates and transports the developer in the axial direction simultaneously and supplies it to the developing roller. A guide member has a sloping surface guiding the developer torn off from the developing roller to the first agitation transport member. The magnetic pole is arranged between horizontal positions of the sloping surface, and the magnetic pole is arranged horizontally outward of the lower end of the sloping surface.

3 Claims, 1 Drawing Sheet

DEVELOPING UNIT

CROSS-REFERENCE TO RELATED APPLICATIONS

This application claims priority to Japanese Patent Application No. 2005-133091. The entire disclosure of Japanese Patent Application No. 2005-133091 is hereby incorporated herein by reference.

BACKGROUND OF THE INVENTION

1. Field of the Invention

The present invention relates to a developing unit.

2. Background Information

An electrophotographic image forming device such as a laser printer or a copying machine comprises a photosensitive drum and a developing unit that provides toner to the surface of the photosensitive drum. In addition, the developing unit includes a developing roller that supports developer on the surface thereof, and an agitation transport member that agitates the developer while simultaneously transporting it in the axial direction and providing it to the developing roller. Furthermore, the developing roller generally includes a plurality of magnetic poles, including a drawing pole that draws developer onto the surface of the developing roller and a peel-off pole that peels off the developer remaining on the surface of the developing roller after passing by a developing region in which toner is supplied to the photosensitive drum from the surface of the developing roller.

Japan Patent Application Publication JP-A-04-060665 discloses the above described type of developing unit, which includes a first agitation transport member and a second agitation transport member, which are arranged parallel to each other in a horizontal direction, and a developing roller arranged above the first and the second agitation transport members. According to this developing unit, the two agitation transport members are arranged parallel to each other. Therefore, it is possible to manufacture the entire developing unit to be slim. In addition, according to this developing unit, it is possible to arrange the developing unit below the photosensitive drum. Thus, it is possible to miniaturize the image forming device in the lateral direction.

However, in this developing unit, the developer contained in the first agitation transport member side is drawn to the developing roller and transported to the developing region. The remaining developer is peeled off the surface of the developing roller after passing the developing region, and dropped on the second agitation transport member side. As a result, the amount of the developer increases on the second agitation transport member side. On the other hand, the amount of the developer on the first agitation transport member side decreases. Thus, the amount of the developer contained in the two sides becomes imbalanced. Accordingly, the density of the developed image may appear to be weak, or the developer may overflow out of the second agitation transport member side.

In order to resolve the above described problem, Japan Patent Application Publication JP-A-10-123816 discloses a developing unit in which the amount of the developer contained on the first agitation transport member side and the second agitation transport member side can be balanced. In this developing unit, a larger quantity of developer contained in the second agitation transport member side will be moved to the first agitation transport members side by taking one of the following measures, for instance. One measure is forming a sloping base on a housing so that the first agitation transport member side can be arranged below the second agitation transport member side. The other measure is adjusting the amount of the developer transported between these two agitation transport members by changing the size of an opening formed on the partition plate that is arranged between these two agitation transport members in the horizontal direction.

However, if the base of the housing is formed in a slope, the entire first agitation transport member will be drowned by the developer. Thus, agitating and transporting the upper portion of the developer away from the agitation transport member will be extremely difficult. On the other hand, enlarging the openings on the partition plate will not effectively balance the amount of developing agent on the two agitation transport member sides, because it will be time consuming. Therefore, this solution will only be sufficient for a low speed image forming device that outputs a few number of print sheets at a time.

On the other hand, Japan Patent Application Publication JP-A-2002-148915 discloses a developing unit in which the developing roller is arranged diagonally above the first agitation transport member and facing the second agitation transport member. More specifically, in this developing unit, the first agitation transport member and the second agitation transport member are arranged to be parallel to each other and separated by a partition plate which has openings on both ends in the axial direction. Here, the developer is drawn from the first agitation transport member side onto the developing roller that is arranged diagonally above the first agitation transport member. In addition, the developer will be peeled off from the surface of the developing roller after passing the developing region, and returned back to the first agitation transport member side.

However, if a structure in which four developing units corresponding to four color developers, i.e., the yellow (Y) developer, the magenta (M) developer, the cyan (C) developer, and the black (K) developer, are respectively arranged parallel to each other in the horizontal direction, just like a tandem full color printer, the horizontal size thereof will be increased. Therefore, it is difficult to miniaturize the developing unit. On the other hand, if the horizontal size of the image forming device needs to be reduced, the arrangement of the developing roller has to be closely similar to that described in Japan Patent Application Publication JP-A-10-123816. In this case, the above described problem regarding the invention described in the publication will be caused.

A portion of the developer peeled off from the developing roller may be magnetically attracted to the developing roller without being agitated by the agitation transport member, and thus directly drawn to the surface of the developing roller. As a result, an excessive amount of charge will be applied to the developer. Thus, the amount of the developer supplied to the photosensitive drum will decrease, and the developed image will appear to be pale in color.

In addition, the developing unit disclosed in Japan Patent Application Publication JP-A-2002-148915 has a large width (i.e., large horizontal length). Because of this, an image forming device, such as a tandem color printer in which a plurality of the developing units are arranged parallel to each other in the horizontal direction, will have a large horizontal size.

In view of the above, it will be apparent to those skilled in the art from this disclosure that there exists a need for an improved developing unit. This invention addresses this need in the art as well as other needs, which will become apparent to those skilled in the art from this disclosure.

SUMMARY OF THE INVENTION

It is therefore an object of the present invention to provide a developing unit in an image forming device, in which developer peeled off from a developing roller can be reliably retrieved to the agitation transport member side. Thus, the problem caused when developer peeled off from the developing roller is directly drawn thereto can be solved.

In accordance with a first aspect of the present invention, a developing unit is comprised of (A) a developing roller that can support developer on the surface thereof, and includes (i) a drawing magnetic pole that draws the developer thereto, and (ii) a peel-off magnetic pole that peels off the developer from the surface of the developing roller, (B) an agitation transport unit that is arranged below the developing roller, and agitates and transports the developer in the axial direction to supply the developer to the developing roller, and (C) a guide member that has a sloping surface and guides the developer peeled off from the surface of the developing roller to the agitation transport unit. Here, the peel-off magnetic roller is arranged within a horizontal region of the sloping surface, and the drawing magnetic pole is arranged horizontally outward of the lower end of the sloping surface.

According to the first aspect of the present invention, the developer is peeled off from the developing roller after it is drawn from the agitation transport member to the developing roller and passes the developing region. However, the developer torn off from the developing roller will be reliably guided to the agitation transport member side by the sloping surface formed in the guide unit. Therefore, it is possible to more reliably retrieve the developer, and thus it is possible to avoid the developer that was peeled off from the developing roller from being directly drawn thereto before it is mixed with the fresh developer. Because of this, it is possible to prevent the density of the developer from being lowered, and to prevent the quality of the developer from deteriorating due to the extreme charging of the developer.

In the present invention, directional terms such as "horizontal," "above" or "below," mean the direction based on the normal usage situation of the image forming device for which a developing unit in accordance with the present invention is applied.

For example, a rotational axis of the developing roller may be located in any vertical position with respect to the sloping surface if it is located between both ends of the sloping surface in the horizontal direction.

In addition, "horizontally outward" means the outer side of the horizontal region of the sloping surface in the horizontal direction.

In accordance with a second aspect of the present invention, a developing unit is comprised of (A) a developing roller that can support developer on the surface thereof, and is comprised of (i) a drawing magnetic pole that draws the developer thereto, and (ii) a peel-off magnetic pole that peels off the developer from the surface of the developing roller, (B) a first agitation transport unit that is arranged below the developing roller and agitates and transports the developer in the axial direction to supply the developer to the developing roller, (C) a second agitation transport unit that is arranged below the developing roller and parallel to the first agitation transport unit in the horizontal direction, and is capable of circulating and transporting the developer with the first agitation transport unit, and mixing the developer and externally supplied developer, (D) a partition member that is arranged between the first agitation transport unit and the second agitation transport unit in the horizontal direction, and connects the first agitation transport unit side and the second agitation transport unit side through a region in the axial direction, and (E) a guide member that has a sloping surface that guides the developer peeled off from the surface of the developing roller to the first agitation transport unit. Here, the peel-off magnetic pole is arranged within a horizontal region of the sloping surface of the guide member, and the drawing magnetic roller is arranged horizontally outward of the lower end of the sloping surface of the guide member.

According to the second aspect of the present invention, the developer is circulated and transported by the two agitation transport members. However, the developer peeled off from the developing roller is reliably guided to the first agitation transport member side by the guide member having a sloping surface. Therefore, it is possible to easily keep a balance between the amount of the developer contained in the first agitation transport member side and the amount of the developer contained in the second agitation transport member side.

In accordance with a third aspect of the present invention, in the developing unit according to the second aspect of the present invention, the partition member and the guide member are formed to be integral with each other.

According to the third aspect of the present invention, the number of components can be reduced, and it is easy to assemble the developing unit.

As described above, according to the present invention, developer that is peeled off from the developing roller will be reliably guided to the agitation transport member side through a sloping surface that functions as a guide. Therefore, the developer peeled off from the developing roller can be reliably retrieved, and can avoided being directly drawn thereto before it is mixed with fresh developer. Because of this, it is possible to prevent the quality of the developer from deteriorating, and to prevent a reduction in the density of the developer due to the extreme charging of the developer.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Structure of the Developing Unit

Figure 1:
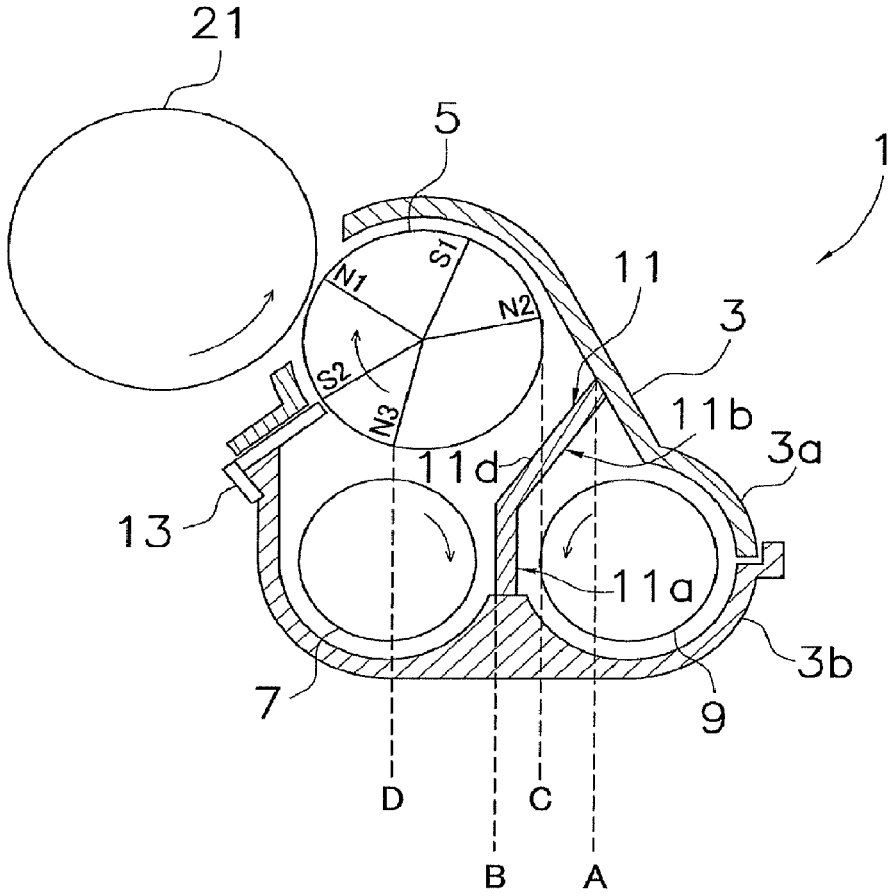
FIG. 1 is a vertical cross-section diagram showing a developing unit in accordance with one embodiment of the present invention.
Figure 2:
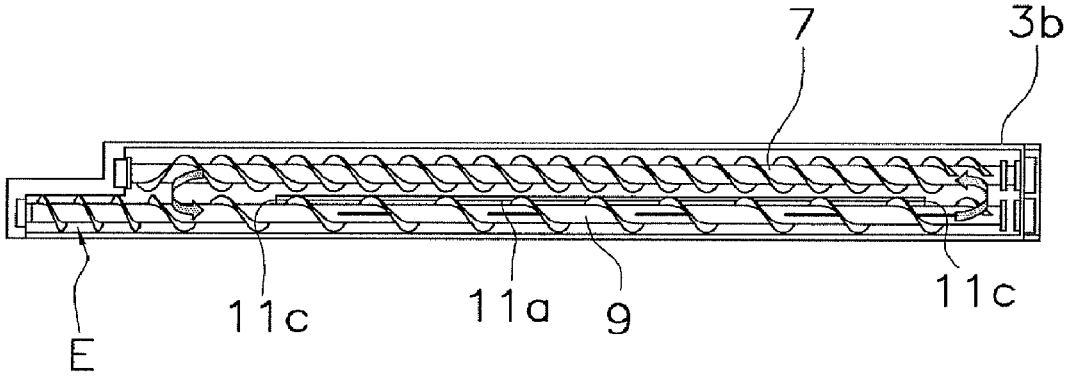
FIG. 2 is a top perspective view of the developing unit in accordance with one embodiment of the present invention.

FIGS. 1 and 2 show diagrams of a developing unit 1 in accordance with one embodiment of the present invention.

The developing unit 1 is arranged in a tandem full color printer (not shown in the figure), and arranged to be adjacent to a photosensitive drum 21 installed in the full color printer. The developing unit 1 is comprised of a housing 3, a developing roller 5, a first agitation transport member 7, a second agitation transport member 9, a bulkhead 11 comprised of a partition member 11*a* and a guide member 11*b*, and a blade 13.

The housing 3 is a member that forms a portion of the chassis of the developing unit 1. The housing 3 is primarily comprised of an upper housing member 3*a*, and a lower housing member 3*b* attached to the upper housing member 3*a*.

The developing roller 5 is a rotational body which can attach the developer on its surface. As shown in FIG. 1, five magnetic poles N1, N2, N3, S1, and S2 are fixed in the inside of the developing roller 5. The magnetic pole N3 is a drawing magnetic pole that draws the developer, and the magnetic pole N2 is a peel-off magnetic pole that peels off the developer from the surface of the developing roller 5. As shown in FIG. 1, the magnetic poles N2 and N3 are arranged in the horizontal positions C and D, respectively.

In addition, the developing roller 5 is arranged in the interior of the housing 3 so that its lower end is located above the upper ends of the agitation transport members 7 and 9, and its rotary shaft is located between the agitation transport members 7 and 9 in the horizontal direction.

The first agitation transport member 7 is configured to simultaneously agitate and transport the developer in the axial direction and supply the developer to the developing roller 5.

The second agitation transport member 9 is arranged to be parallel with the first agitation transport member 7 in the horizontal direction. The second agitation transport member 9 can circulate and transport developer together with the first agitation transport member 7, and mix the developer contained in the housing 3 with the toner replenished from a hopper (not shown in the figures) installed in the full color printer. Here, the toner is replenished from the hopper through a region E shown in FIG. 2

The bulkhead 11 comprises the partition member 11*a* and the guide member 11*b*. The partition member 11*a* divides the two agitation transport members 7 and 9 in the horizontal direction, and the guide member 11*b* guides the toner peeled off from the developing roller 5 to the first agitation transport member 7 side. Here, the partition member 11*a* and the guide member 11*b* are formed to be integrated with each other.

The partition member 11*a* is arranged between the first agitation transport member 7 and the second agitation transport member 9 in the horizontal direction. In addition, as shown in FIG. 2, openings 11*c* are formed on both ends of the partition member 11*a* in the axial direction. The openings 11*c* connect the first agitation transport member 7 side with the second agitation transport member 9 side.

The guide member 11*b* has a sloping surface 11*d* that guides the developer peeled off from the surface of the developing roller 5 to the first agitation transport member 7 side. The upper and the lower ends of the guide member 11*b* are arranged in the horizontal positions A and B, respectively. In addition, the peel-off magnetic pole N2 of the developing roller 5 is located between the horizontal positions A and B. In contrast, the drawing magnetic pole N3 of the developing roller 5 is located toward the photosensitive drum 21 side (i.e., horizontally outward) when the position B is set to the reference position.

The blade 13 controls the thickness of the layer of the drawn developer.

Operation of Developing Unit

An operation of the developing unit 1 is hereinafter explained in detail.

When an image forming operation is requested in a color printer, the developer contained in the housing 3 is drawn by the drawing magnetic pole N3 of the developing roller 5, and the blade 13 both controls the thickness of the layer of the developer and charges the developer. Then, a portion of the developer is supplied to the photosensitive drum 21 from the developing region.

The developer remaining on the developing roller 5 is peeled off by the peel-off magnetic pole N2 after it passes the developing region. Then it drops onto the sloping surface 11*d* of the bulkhead 11, and it is guided to and retrieved on the agitation transport member 7 side along the sloping surface 11*d*.

The retrieved developer is circulated and transported in the interior of the housing 3 through the openings 11*c* formed on the bulkhead 11 by means of the rotary drive of the first agitation transport member 7 and the second agitation transport member 9, and mixed with the toner replenished from the hopper in the second agitation transport member 9.

In the above described developing unit, the developer peeled off from the developing roller 5 will be reliably guided to and retrieved on the first agitation transport member 7 side through the sloping surface 11*d* formed on the bulkhead 11.

In addition, according to the above described developing unit, the developer peeled off from the developing roller 5 will be reliably agitated by the first agitation transport member 7. Therefore, it is possible to prevent the developer from being directly drawn to the developing roller 5 before it is mixed with fresh developer. Furthermore, it is possible to prevent a reduction in the density of the developer, and to prevent the quality of the developer from deteriorating due to the extreme charging of the developer.

Furthermore, according to the developing unit 1, the developing roller 5 can be arranged between the first agitation transport member 7 and the second agitation transport member 9 in the horizontal direction. Therefore, in particular, it is possible to miniaturize the size of an image forming device, such as a tandem full color printer, in which a plurality of developing units are arranged to be parallel with each other.

Alternative Embodiment

In the above described embodiment, the housing may function as the guide member. In addition, the guide member and the partition member may be formed separately from each other.

Furthermore, the developing unit in accordance with the present invention can be applied to any type of electrophotographic image forming device, such as a one-drum color printer or a monochrome laser printer.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing system for an image forming device, comprising:

a photosensitive drum; and a developing unit including a developing roller arranged at the developing position and configured to support a developer, the developing roller comprising a drawing magnetic pole configured to independently draw the developer onto a surface of the developing roller, and a peel-off magnetic pole configured to peel off the developer from the surface of the developing roller, an agitation transport unit arranged below and substantially center of the developing roller and configured to agitate and transport the developer in the axial direction and supply the developer to the developing roller, and a guide member having a sloping surface that guides the developer peeled off from the surface of the developing roller to the agitation transport unit, the peel-off magnetic pole being arranged within a horizontal region of the sloping surface, and the drawing magnetic pole being arranged outwardly in the horizontal direction from the lower end of the sloping surface, the photosensitive drum being arranged lateral to the developing roller and substantially lateral to the outer periphery of the agitation transport unit.

2. A developing system for an image forming device unit, comprising:

a photosensitive drum; and a developing unit including a developing roller arranged at the developing position and configured to support a developer, the developing roller comprising a drawing magnetic pole configured to directly draw the developer onto a surface of the developing roller; and a peel-off magnetic pole that is configured to peel off the developer from the surface of the developing roller, a first agitation transport member arranged below the developing roller and configured to agitate and transport the developer in the axial direction and supply the developer to the developing roller, a second agitation transport member arranged below the developing roller and parallel to the first agitation transport member in the horizontal direction and configured to mix the developer and externally supplied developer and circulate and transport the developer with the first agitation transport member, the developer roller being positioned substantially between the first agitation transport member and the second agitation transport member, a partition member arranged between the first agitation transport member and the second agitation transport member in the horizontal direction and connects the first agitation transport member side and the second agitation transport member side through a region in the axial direction, and a guide member having a sloping surface that guides the developer peeled off from the surface of the developing roller to the first agitation transport member, the peel-off magnetic pole being arranged within a horizontal region of the sloping surface of the guide member, and the drawing magnetic pole being arranged outwardly in the horizontal direction from the lower end of the sloping surface of the guide member, the photosensitive drum being arranged lateral to the developing roller and substantially lateral to the outer periphery of at least one of the first agitation transport member and the second agitation transport member.

3. The developing system according to claim 2, wherein the partition member and the guide member are integral with each other.

* * * * *